US012428810B2

(12) United States Patent
Fukaya et al.

(10) Patent No.: US 12,428,810 B2
(45) Date of Patent: Sep. 30, 2025

(54) OPERATION MECHANISM OF FRONT LOADER AND WORKING VEHICLE

(71) Applicant: KUBOTA CORPORATION, Osaka (JP)

(72) Inventors: Naotaka Fukaya, Osaka (JP); Hiroki Aze, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/739,943

(22) Filed: Jun. 11, 2024

(65) Prior Publication Data

US 2025/0043538 A1 Feb. 6, 2025

(30) Foreign Application Priority Data

Aug. 4, 2023 (JP) ..... 2023-127440

(51) Int. Cl.
*E02F 9/20* (2006.01)

(52) U.S. Cl.
CPC ..... *E02F 9/2004* (2013.01)

(58) Field of Classification Search
CPC ..... E02F 9/2004
See application file for complete search history.

(56) References Cited

U.S. PATENT DOCUMENTS 4,526,055 A 7/1985 Batchelor
8,713,931 B2 * 5/2014 Sakamoto ..... F15B 11/17 60/462
11,447,194 B2 * 9/2022 Tottori ..... G05G 1/04
11,473,268 B2 * 10/2022 Nishigori ..... E02F 9/16
12,222,743 B2 * 2/2025 Hatta ..... E02F 9/20
2018/0326845 A1 11/2018 Ogura et al.

FOREIGN PATENT DOCUMENTS

EP 1801686 A2 * 6/2007 ..... B66F 9/20
EP 3 670 762 A1 6/2020
JP 2000230256 A * 8/2000 ..... E02F 9/2004
JP 2004-360331 A 12/2004
JP 2005075619 A * 3/2005
JP 2017-91061 A 5/2017

OTHER PUBLICATIONS

European Search Report dated Jan. 17, 2025 in European family member application No. 24186402.4.

* cited by examiner

*Primary Examiner* — Faye M Fleming

(74) *Attorney, Agent, or Firm* — Greenblum & Bernstein, P.L.C.

(57) ABSTRACT

Provided are an operation lever, a moving pin movable in a front-rear direction and a left-right direction according to an operation of the operation lever and connected to a control valve, and a restriction mechanism configured to restrict movement of the moving pin in a state where the operation lever is operated to a neutral position. The restriction mechanism includes a ball capable of abutting on a surface of the moving pin, and a spring configured to bias the ball toward the moving pin.

10 Claims, 7 Drawing Sheets

OPERATION MECHANISM OF FRONT LOADER AND WORKING VEHICLE

TECHNICAL FIELD

The disclosure relates to a technique of an operation mechanism of a front loader and a working vehicle.

BACKGROUND ART

Conventionally, a technique of an operation mechanism for operating a front loader is known. For example, JP 2017-91061 A discloses such a technique.

The operation mechanism described in JP 2017-91061 A includes a loader lever, two push-pull wires, and the like. The loader lever is configured to be rockable in a left-right direction and a front-rear direction. The two push-pull wires couplet the loader lever and a loader valve. One of the two push-pull wires moves up and down in a case where the loader lever is rocked in the left-right direction. Furthermore, the other of the two push-pull wires moves up and down in a case where the loader lever is rocked in the front-rear direction. A spool of the loader valve is displaced by the vertical movement of the push-pull wire, and an arm of the front loader and a working tool (bucket) can be operated.

However, there is a possibility that the spool is not displaced (only the push-pull wire is operated) until the loader lever is operated by a predetermined amount or more from a neutral position due to an influence of a gap or the like generated between an inner wire and an outer wire of the push-pull wire. In a case where there is an operation range (backlash) in which the spool is not displaced, there is a possibility that the loader lever moves (backlashes) near the neutral position unintentionally by an operator due to vibration or the like during traveling of a tractor.

SUMMARY OF INVENTION

One aspect of the present disclosure has been made in view of the above circumstances, and an object of the present disclosure is to provide an operation mechanism of a front loader and a working vehicle capable of reducing an influence of backlash of an operation lever.

The problem to be solved by one aspect of the present disclosure is as described above, and means for solving the problem will be described below.

One aspect of the present disclosure includes: an operation lever; a moving member movable in a predetermined direction according to an operation of the operation lever and connected to a control valve; and a restriction mechanism configured to restrict movement of the moving member in a state where the operation lever is operated to a neutral position.

According to one aspect of the present disclosure, the influence of backlash of the operation lever can be reduced by restricting the movement of the moving member.

In one aspect of the present disclosure, the restriction mechanism includes an abutment member capable of abutting on a surface of the moving member, and a biasing member configured to bias the abutment member toward the moving member.

According to one aspect of the present disclosure, the influence of backlash of the operation lever can be reduced with a simple configuration.

In one aspect of the present disclosure, the moving member includes a first recess engageable with the abutment member in a state where the operation lever is operated to the neutral position.

According to one aspect of the present disclosure, the influence of backlash of the operation lever can be effectively reduced.

In one aspect of the present disclosure, the moving member includes a second recess formed to extend along a moving direction of the moving member and configured to guide the abutment member.

According to one aspect of the present disclosure, it is possible to suppress an increase in an operation load of the operation lever due to the provision of the restriction mechanism.

One aspect of the present disclosure further includes a support member in which an accommodation portion that accommodates the moving member is formed, in which the restriction mechanism is provided in a communication hole that communicates an outer surface of the support member and the accommodation portion.

According to one aspect of the present disclosure, the restriction mechanism can be easily provided from the outside of the support member.

In one aspect of the present disclosure, the moving member includes a rotation restriction portion configured to restrict rotation about an axis parallel to a moving direction of the moving member.

According to one aspect of the present disclosure, it is possible to easily position the moving member with respect to the support member.

In one aspect of the present disclosure, the moving member includes a boom moving member configured to control an operation of a boom of the front loader, and a bucket moving member configured to control an operation of a bucket of the front loader.

According to one aspect of the present disclosure, the influence of backlash of the operation lever in two operation directions can be reduced.

One aspect of the present disclosure includes the above-described operation mechanism of a front loader.

According to one aspect of the present disclosure, the influence of backlash of the operation lever can be reduced.

According to one aspect of the present disclosure, the influence of backlash of the operation lever can be reduced.

DESCRIPTION OF EMBODIMENTS

Figure 1:
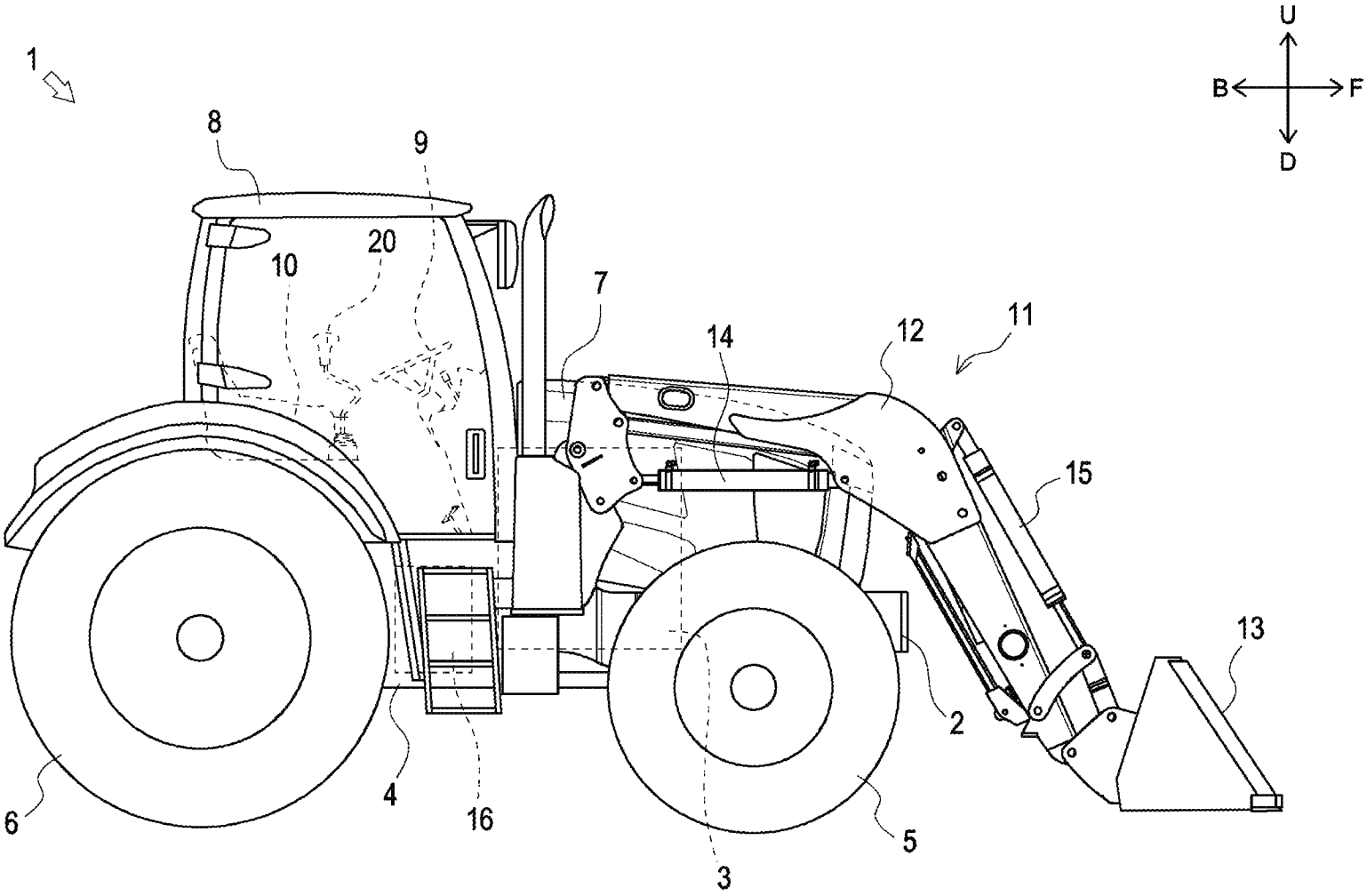
FIG. 1 is a side view of a tractor according to an embodiment of the disclosure.

In the following description, directions indicated by arrows U, D, F, B, L, and R in the drawings are defined as an upward direction, a downward direction, a forward direction, a backward direction, a left direction, and a right direction, respectively.

Hereinafter, a tractor 1 according to an embodiment of the disclosure will be described with reference to FIG. 1.

The tractor 1 mainly includes a machine body frame 2, an engine 3, a transmission case 4, front wheels 5, rear wheels 6, a bonnet 7, a cabin 8, a steering wheel 9, a seat 10, and a front loader 11.

The machine body frame 2 is a frame-shaped member formed by appropriately combining a plurality of panel members. The machine body frame 2 is formed in a substantially rectangular shape in plan view. The machine body frame 2 is disposed with its longitudinal direction oriented in a front-rear direction. The engine 3 is fixed to a rear portion of the machine body frame 2. The transmission case 4 is fixed to a rear portion of the engine 3. A front portion of the machine body frame 2 is supported by the pair of left and right front wheels 5 through a front axle mechanism (not illustrated). A rear portion of the transmission case 4 is supported by the pair of left and right rear wheels 6 through a rear axle mechanism (not illustrated). The engine 3 is covered with the bonnet 7.

Power of the engine 3 can be transmitted to the front wheels 5 through the front axle mechanism and can be transmitted to the rear wheels 6 through the rear axle mechanism after being shifted by a transmission device (not illustrated) accommodated in the transmission case 4. The front wheels 5 and the rear wheels 6 are rotationally driven by the power of the engine 3, and the tractor 1 can travel.

The cabin 8 is provided behind the engine 3. A steering wheel 9 and various operation tools for adjusting a turning angle of the front wheels 5 are disposed in a front portion of the cabin 8. The seat 10 on which a driver sits is disposed substantially at a center of the cabin 8. Furthermore, an operation mechanism 20 for operating the front loader 11 is provided near the seat 10.

The front loader 11 is attached to a front portion of the tractor 1. The front loader 11 includes a boom 12, a bucket 13, a boom cylinder 14, a bucket cylinder 15, a control valve 16, and the like.

The boom 12 is disposed so as to extend forward and downward. The bucket 13 is detachably coupled to a front end portion of the boom 12. The control valve 16 is configured to be able to feed hydraulic pressure to the boom cylinder 14 and the bucket cylinder 15. The control valve 16 is disposed below the cabin 8. The boom 12 can be rotated with respect to a vehicle body by expansion and contraction of the boom cylinder 14 by the hydraulic pressure from the control valve 16. The bucket 13 can rotate with respect to the boom 12 when the bucket cylinder 15 is expanded and contracted by the hydraulic pressure from the control valve 16. As described above, the work of transporting earth and sand, and the like can be carried out while appropriately rotating the boom 12 and the bucket 13.

Hereinafter, the operation mechanism 20 of the front loader 11 will be described with reference to FIGS. 2 to 6A and 6B.

Figure 2:
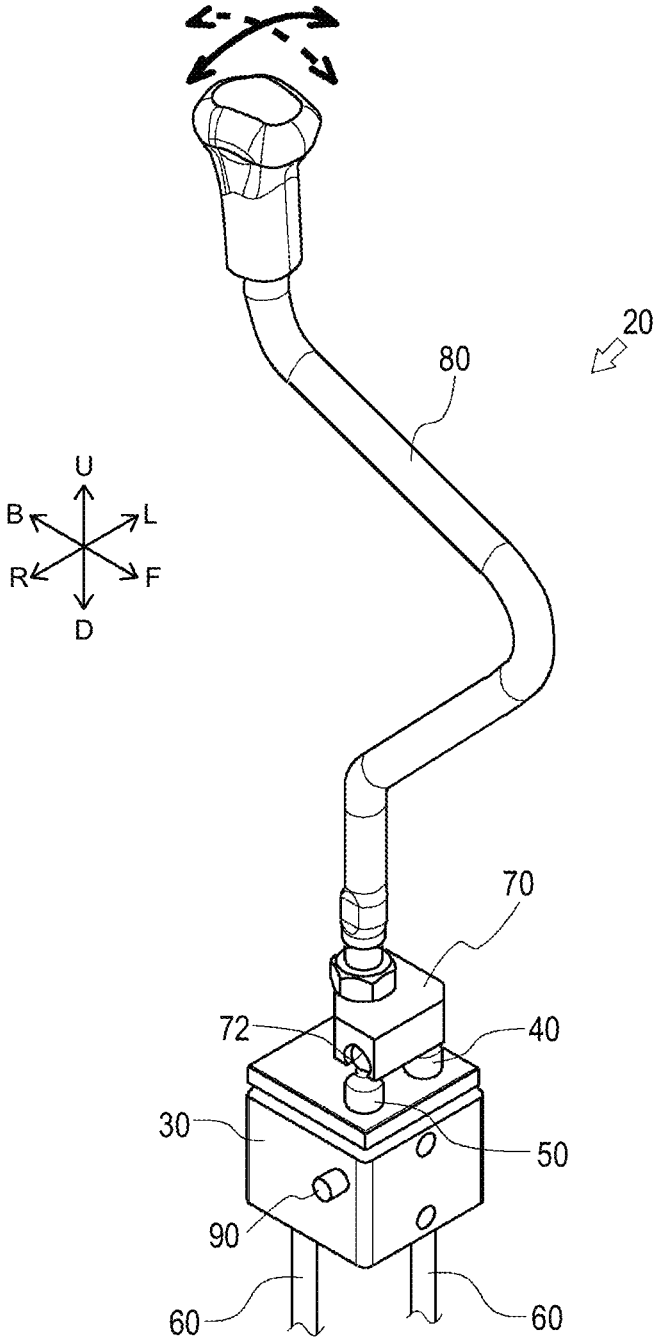
FIG. 2 is a perspective view of an operation mechanism.

The operation mechanism 20 is for operating the front loader 11 in accordance with an operation of an operator. As illustrated in FIG. 2, the operation mechanism 20 includes a support member 30, a fixing pin 40, a moving pin 50, a cable 60, a coupling member 70, an operation lever 80, and a restriction mechanism 90. Note that FIGS. 2 to 5 illustrate the operation mechanism 20 in a case where the operation lever 80 is located at a neutral position.

Figure 3:
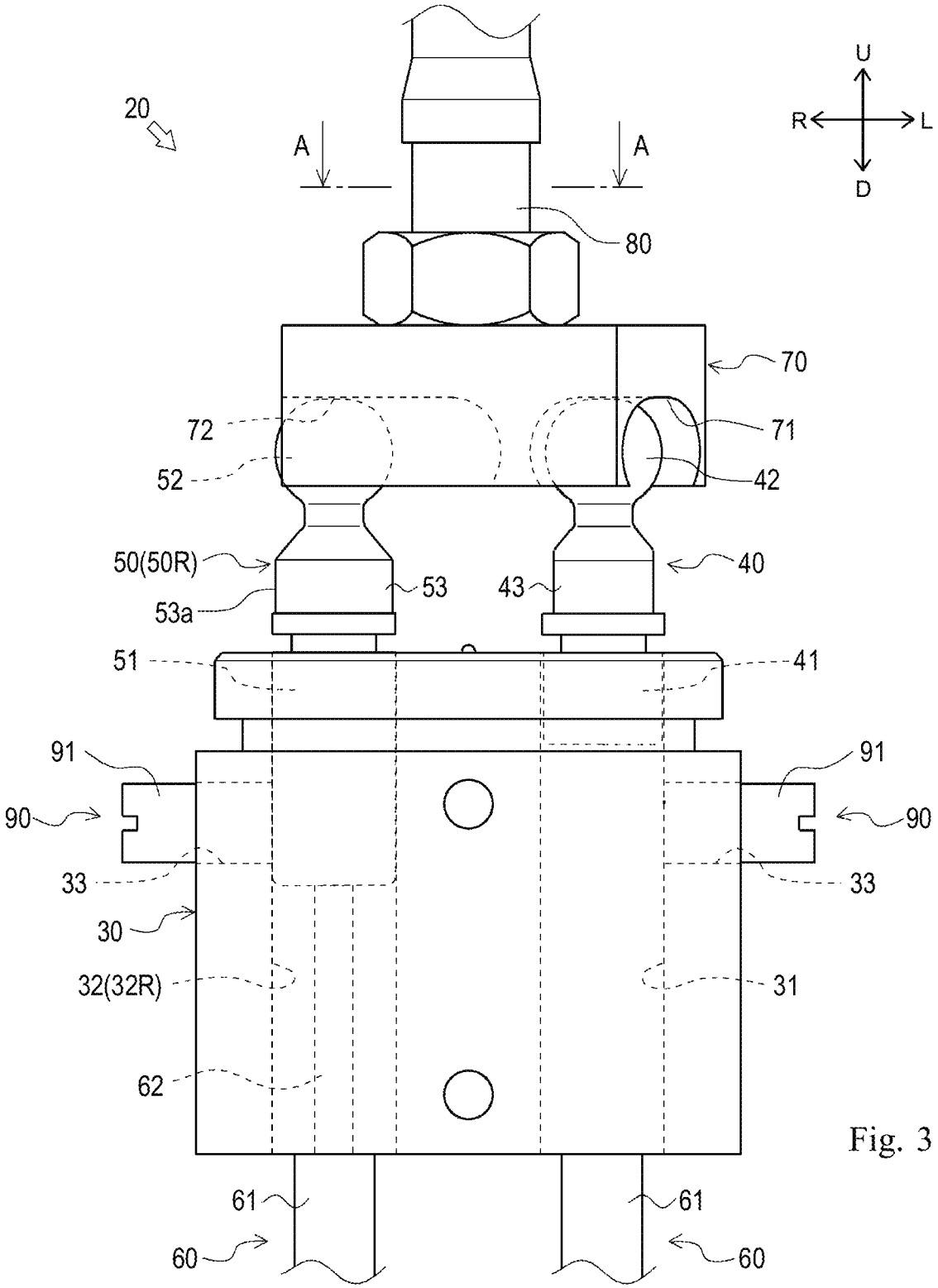
FIG. 3 is an enlarged front view of the same.
Figure 4A:
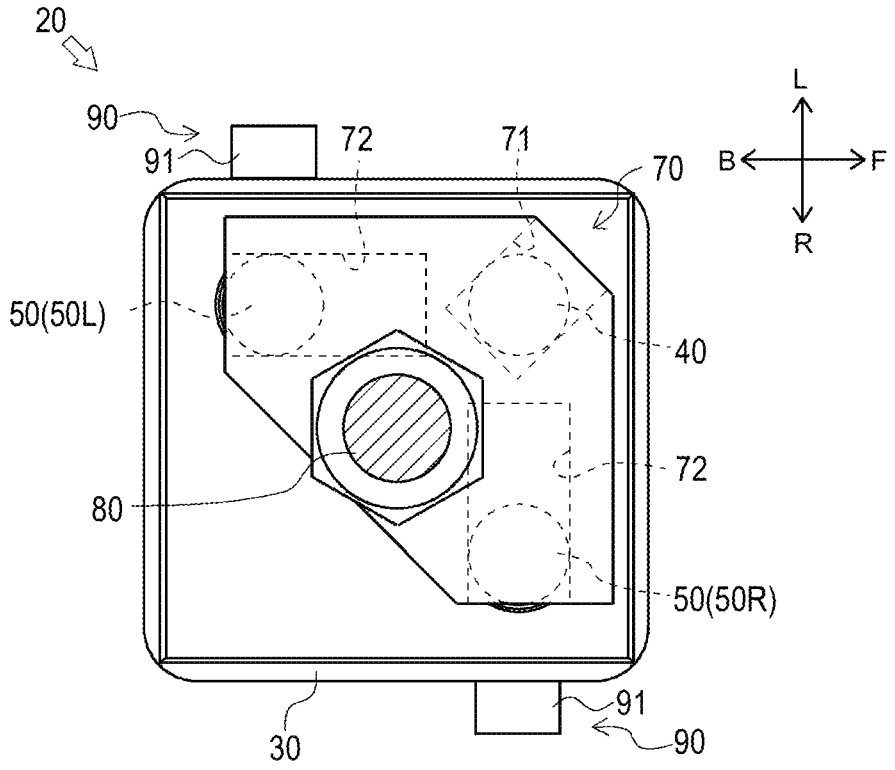
FIG. 4A is a cross-sectional view taken along line A-A.
Figure 4B:
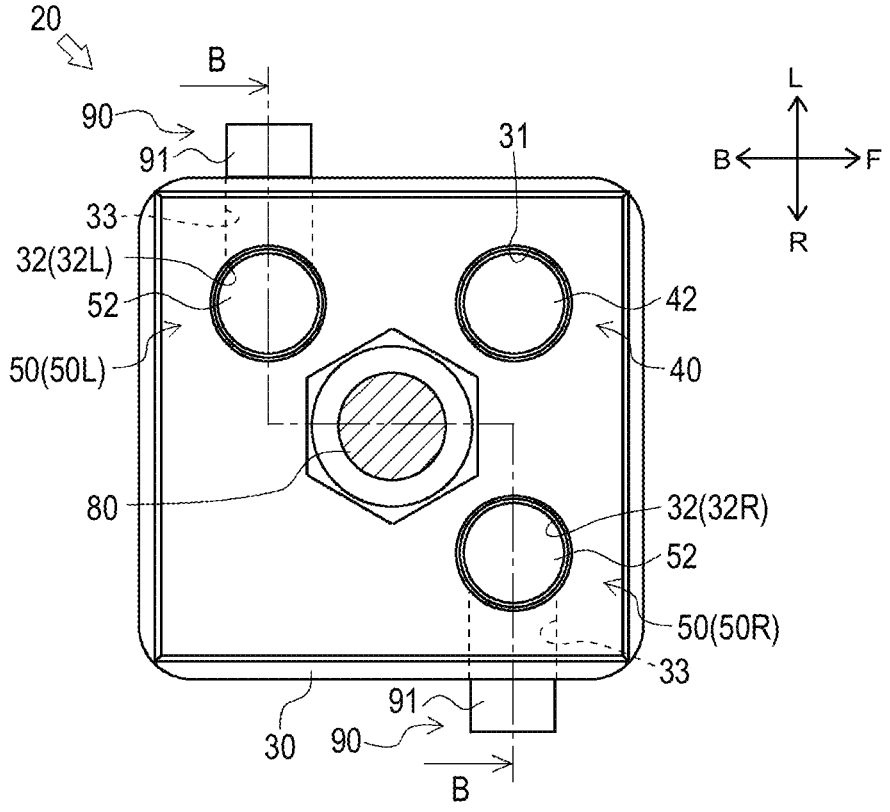
FIG. 4B is a view in which a coupling member illustrated in FIG. 4A is omitted.

The support member 30 illustrated in FIGS. 2, 3, and 4B is a member for supporting various members (the fixing pin 40 and the like) of the operation mechanism 20. The support member 30 is formed in a substantially rectangular parallelepiped shape. The support member 30 is provided in the cabin 8. As illustrated in FIGS. 3 and 4B, the support member 30 includes a first through hole 31, a second through hole 32, and a communication hole 33.

The first through hole 31 and the second through hole 32 vertically penetrate the support member 30. The first through hole 31 and the second through hole 32 are formed in a substantially circular shape in plan view. The first through hole 31 is formed in a left front portion of the support member 30. The second through hole 32 is formed in each of a left rear portion and a right front portion of the support member 30. Hereinafter, the second through hole 32 formed in the left rear portion of the support member 30 is referred to as a "left second through hole 32L". Furthermore, the second through hole 32 formed in the right front portion of the support member 30 is referred to as a "right second through hole 32R".

Figure 5:
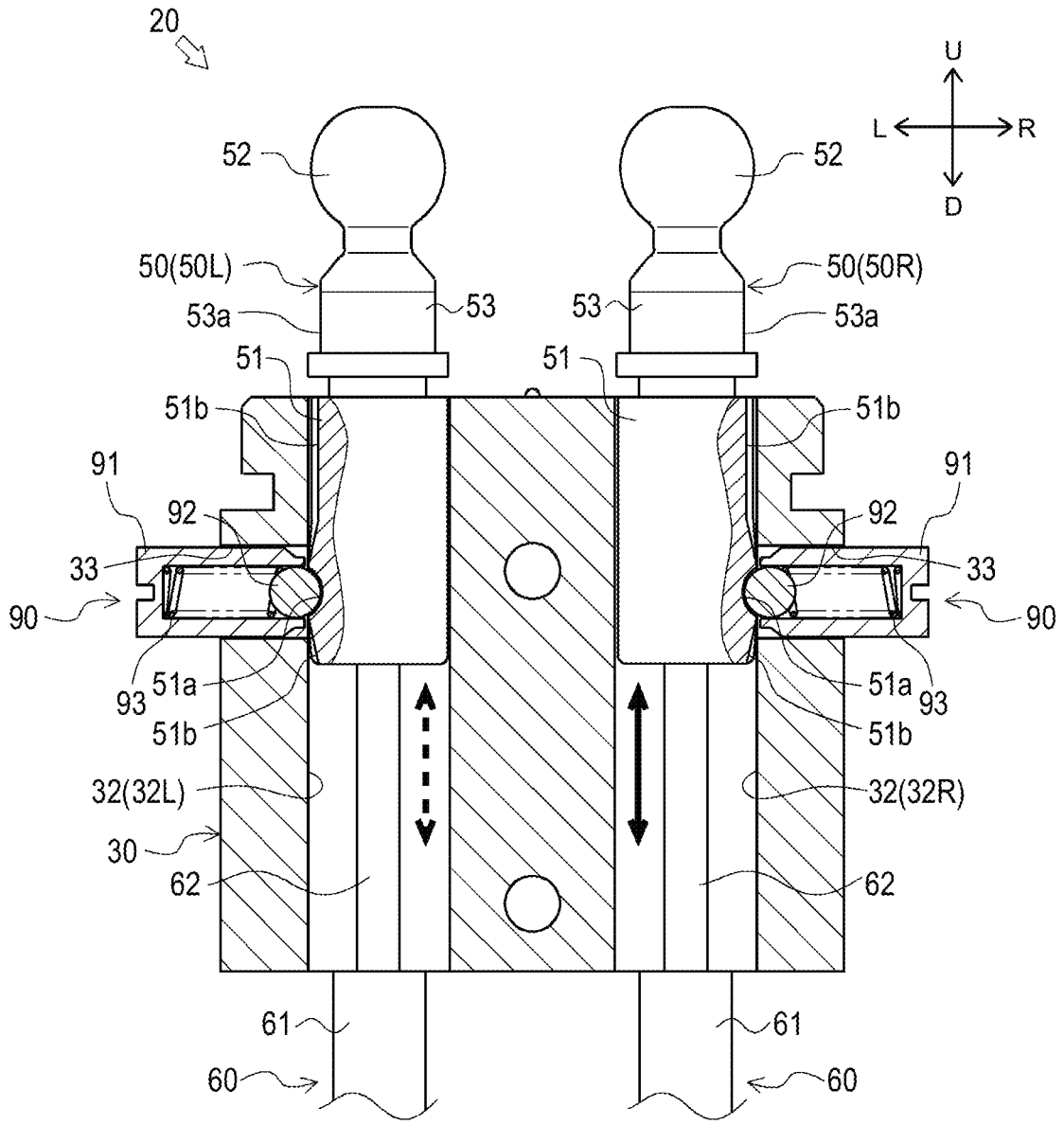
FIG. 5 is a cross-sectional view taken along line B-B.

The communication hole 33 illustrated in FIGS. 4B and 5 is a hole that allows the second through hole 32 and an outer surface of the support member 30 to communicate with each other. One communication hole 33 is formed for one second through hole 32. The communication hole 33 is formed to extend in the left-right direction. The communication hole 33 is formed in a substantially circular shape in side view. The communication hole 33 is formed so as to communicate the left second through hole 32L with a left side surface of the support member 30. Furthermore, the communication hole 33 is formed to communicate the right second through hole 32R with a right side surface of the support member 30. A female screw portion is formed (not illustrated) on an inner peripheral surface of each of the communication holes 33.

The fixing pin 40 illustrated in FIGS. 3, 4A and 4B is a member fixed to the support member 30. The fixing pin 40 includes a columnar portion 41, a spherical portion 42, and a connection portion 43. The columnar portion 41 is a columnar portion whose axial direction is oriented in the vertical direction. The columnar portion 41 is fixed to the first through hole 31. The spherical portion 42 is a portion formed in a substantially spherical shape. The spherical portion 42 is formed above the columnar portion 41. The connection portion 43 is a portion that connects the columnar portion 41 and the spherical portion 42. The spherical portion 42 and the connection portion 43 are located above the support member 30.

The moving pin 50 illustrated in FIGS. 4B and 5 is a member relatively movable in the vertical direction with respect to the support member 30. The moving pin 50 is provided in each of the left and right second through holes 32L and 32R. Hereinafter, the moving pin 50 provided in the left second through hole 32L is referred to as a "left moving pin 50L". Furthermore, the moving pin 50 provided in the right second through hole 32R is referred to as a "right moving pin 50R". Hereinafter, the configuration of the moving pin 50 will be described by taking the right moving pin 50R as an example. The moving pin 50 includes a columnar portion 51, a spherical portion 52, and a connection portion 53.

The columnar portion 51 is a columnar portion whose axial direction is oriented in the vertical direction. An outer diameter of the columnar portion 51 is smaller than an inner diameter of the second through hole 32. The columnar portion 51 is accommodated in the second through hole 32.

Figure 6A:
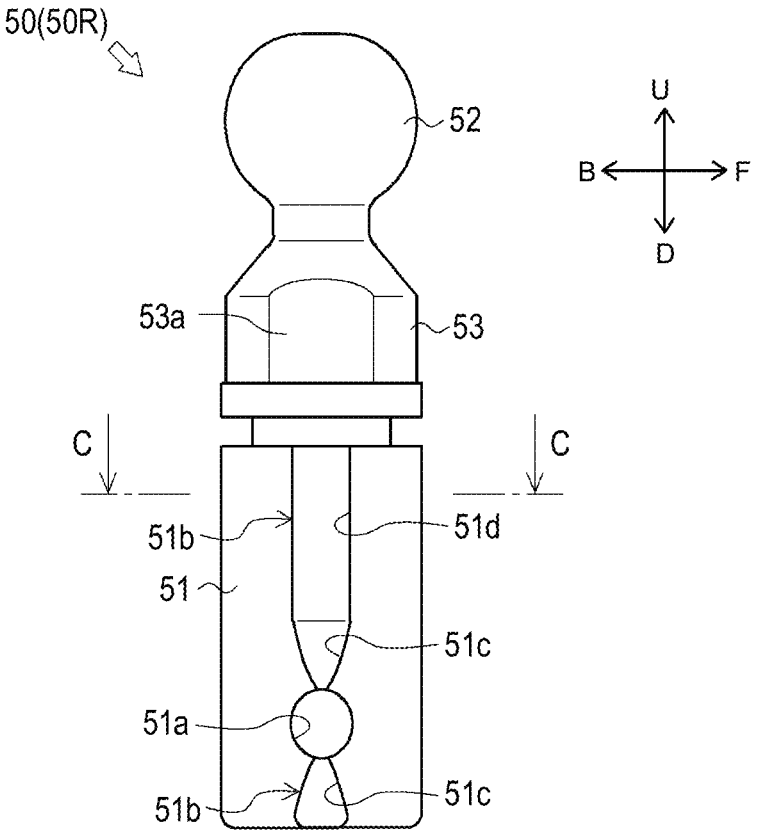
FIG. 6A is a side view illustrating a moving pin.
Figure 6B:
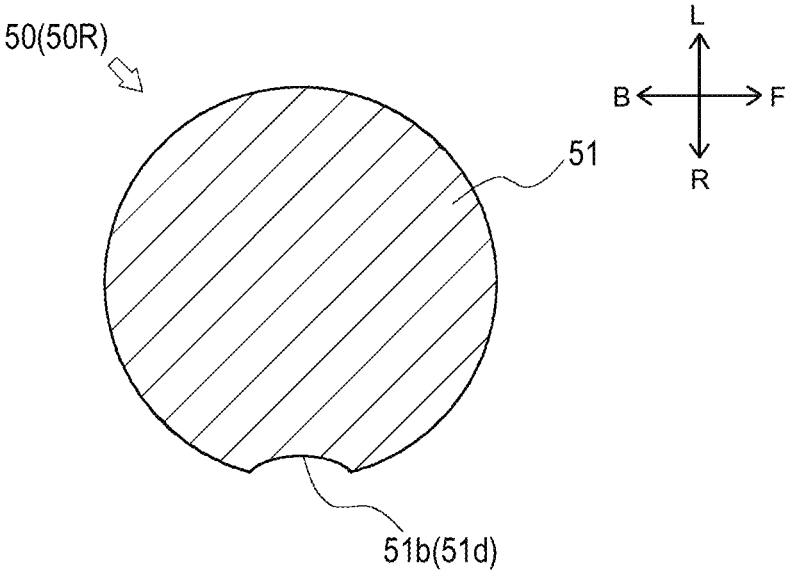
FIG. 6B is a cross-sectional view taken along line C-C.

As illustrated in FIGS. 5 and 6A, the columnar portion 51 includes a first recess 51*a* and a second recess 51*b*.

The first recess 51*a* and the second recess 51*b* are formed to be recessed leftward (toward a center of the columnar portion 51) on an outer peripheral surface of the columnar portion 51. The first recess 51*a* is formed in a substantially hemispherical shape along a ball 92 of the restriction mechanism 90 described later. The first recess 51*a* is formed in a lower portion of the columnar portion 51.

The second recess 51*b* is formed so as to extend in the vertical direction (moving direction of the moving pin 50) from the first recess 51*a*. A depth of the second recess 51*b* is shallower than that of the first recess 51*a*. Note that a magnitude relationship between the depths of the first recess 51*a* and the second recess 51*b* is not limited to the present embodiment. For example, the first recess 51*a* and the second recess 51*b* may have the same depth. The second recess 51*b* is formed on each of an upper side and a lower side of the first recess 51*a*. As illustrated in FIG. 6A, the second recess 51*b* on the upper side includes a sharp portion 51*c* and a straight portion 51*d*.

The sharp portion 51*c* is a portion formed in a tapered shape in which a lateral width decreases toward the first recess 51*a*. The straight portion 51*d* is a portion extending in the vertical direction with a constant lateral width. The straight portion 51*d* is formed in a substantially arc shape in plan cross-sectional view (see FIG. 6B). The straight portion 51*d* is formed to extend from the sharp portion 51*c* to an upper end portion of the columnar portion 51.

The second recess 51*b* on the lower side includes only the sharp portion 51*c* of the above-described sharp portion 51*c* and straight portion 51*d*. Note that the second recess 51*b* on the lower side may include the straight portion 51*d* according to an amount of movement of the moving pin 50, a vertical position of the first recess 51*a*, and the like.

The spherical portion 52 illustrated in FIGS. 5 and 6A is formed above the columnar portion 51. The spherical portion 52 is formed in the same shape as the spherical portion 42 of the fixing pin 40.

The connection portion 53 is a portion that connects the columnar portion 51 and the spherical portion 52. The connection portion 53 is formed in a substantially columnar shape. A flat portion 53*a* is formed in the connection portion 53. The flat portion 53*a* is disposed above the first recess 51*a* and the second recess 51*b* so as to face rightward. The flat portion 53*a* is located above the second through hole 32.

The cable 60 illustrated in FIG. 5 is for transmitting an operation force of the operation lever 80 to the control valve 16. The cable 60 is formed in a longitudinal shape (linear shape) and has flexibility. The cable 60 connects the left and right moving pins 50L and 50R and the control valve 16. The cable 60 includes an outer cable 61 and an inner cable 62.

The outer cable 61 is formed so as to cover the inner cable 62. One end portion of the outer cable 61 is coupled to the support member 30. The other end portion of the outer cable 61 is fixed to the vehicle body in the vicinity of the control valve 16 illustrated in FIG. 1.

One end portion of the inner cable 62 illustrated in FIG. 5 protrudes upward from the one end portion of the outer cable 61 and is coupled to the moving pin 50. The other end portion of the inner cable 62 protrudes from the other end portion of the outer cable 61 and is coupled to the spool of the control valve 16 illustrated in FIG. 1. More specifically, the other end portion of the outer cable 61 is coupled to the spool by inserting a pin into a hole portion formed in the spool.

The coupling member 70 illustrated in FIGS. 2, 3, and 4A is a member to which the operation lever 80 is coupled. The coupling member 70 is formed in a plate shape with a plate surface oriented in the vertical direction. The coupling member 70 is disposed above the support member 30. The coupling member 70 includes a first notch 71 and a second notch 72.

The first notch 71 illustrated in FIGS. 3 and 4A has a substantially semicircular cross-sectional shape with an opening facing downward, and is formed so as to extend from a left front end of the coupling member 70 to the right rear. The first notch 71 is formed in a left front portion of the coupling member 70 (above the first through hole 31). The spherical portion 42 of the fixing pin 40 is accommodated in the first notch 71.

The second notch 72 is formed in a left rear portion (above the left second through hole 32) and a right front portion (above the right second through hole 32) of the coupling member 70. The second notch 72 at the left rear portion has a substantially semicircular cross-sectional shape with an opening facing downward, and is formed to extend forward from a rear side surface of the coupling member 70. The spherical portion 52 of the left moving pin 50L is accommodated in the second notch 72 at the left rear portion. The second notch 72 at the right front portion has a substantially semicircular cross-sectional shape with an opening facing downward, and is formed to extend leftward from a right side surface of the coupling member 70. The spherical portion 52 of the right moving pin 50R is accommodated in the second notch 72 at the right front portion.

The operation lever 80 illustrated in FIG. 2 is a member that can be operated by an operator. The operation lever 80 is formed by appropriately bending a rod-like member. A lower end portion of the operation lever 80 is coupled to the coupling member 70. The lower end portion of the operation lever 80 is located at a position not overlapping with the fixing pin 40 and the moving pin 50 in plan view (see FIGS. 4A and 4B).

As illustrated in FIG. 2, the operation lever 80 is configured to be operable in the left-right direction and the front-rear direction from the neutral position. In a case where the operation lever 80 is moved in the left-right direction, the coupling member 70 rocks left and right with the fixing pin 40 as a fulcrum. With this rocking, the right front portion of the coupling member 70 rocks up and down, and the right moving pin 50R accommodated in the second notch 72 of the right front portion is moved in the vertical direction. Thus, as illustrated in FIG. 5, the right moving pin 50R slides in the vertical direction with respect to the right second through hole 32R of the support member 30. Along with the sliding, the cable 60 (inner cable 62) coupled to the right moving pin 50R is moved in the vertical direction, the spool of the control valve 16 is displaced, and the bucket cylinder 15 is controlled. As a result, the operator can operate the bucket 13 according to the operation of the operation lever 80 in the left-right direction.

Furthermore, in a case where the operation lever 80 illustrated in FIG. 2 is rocked in the front-rear direction, the coupling member 70 rocks back and forth with the fixing pin 40 as a fulcrum. With this rocking, the left rear portion of the coupling member 70 rocks up and down, and the left moving pin 50L accommodated in the second notch 72 of the left rear portion is moved in the vertical direction. Thus, as illustrated in FIG. 5, the left moving pin 50L slides in the vertical direction with respect to the left second through hole 32L of the support member 30. Along with the sliding, the cable 60 (inner cable 62) coupled to the left moving pin 50L is moved in the vertical direction, the spool of the control valve 16 is displaced, and the boom cylinder 14 is controlled. As a result, the operator can operate the boom 12 according to the operation of the operation lever 80 in the front-rear direction.

Here, there is a possibility that the spool is not displaced (only the cable 60 moves) until the operation lever 80 is operated by a predetermined amount or more from the vicinity of the neutral position due to an influence of a gap generated between the outer cable 61 and the inner cable 62, a gap generated at a coupling portion between the spool and the cable 60 (between the hole portion of the spool and the pin), and the like. In a case where there is an operation range (backlash) in which the spool is not displaced, there is a possibility that the operation lever 80 moves (backlash) near the center position unintentionally by the operator due to vibration or the like during traveling of the tractor 1.

The restriction mechanism 90 illustrated in FIGS. 4A, 4B and 5 restricts the movement of the moving pin 50 located at the neutral position to reduce the influence of the above-described backlash (backlash during traveling). The restriction mechanism 90 is provided on the support member 30. One restriction mechanism 90 is provided for one moving pin 50. Hereinafter, the configuration of the restriction mechanism 90 will be described by taking as an example the restriction mechanism 90 that restricts the movement of the right moving pin 50R. The restriction mechanism 90 includes an accommodation member 91, a ball 92, and a spring 93.

The accommodation member 91 illustrated in FIG. 5 is a member for accommodating the ball 92 and the spring 93. The accommodation member 91 is formed in a bottomed substantially cylindrical shape. The accommodation member 91 is disposed with an axial direction oriented in the left-right direction. Furthermore, the accommodation member 91 is disposed such that an opening faces the left side (second through hole 32). A male screw portion is formed on an outer peripheral surface of the accommodation member 91 (not illustrated). The accommodation member 91 is attached to the support member 30 by being screwed into the communication hole 33.

The ball 92 is disposed in an opening of the support member 30 (an end portion on a side of the second through hole 32). A part of the ball 92 protrudes from the opening. The ball 92 abuts on (engages with) the first recess 51*a* of the moving pin 50 in a state where the operation lever 80 is located at the neutral position (state illustrated in FIG. 5).

The spring 93 biases the ball 92 leftward (toward the moving pin 50). The spring 93 is accommodated in the accommodation member 91 and is disposed between a bottom (right end portion) of the accommodation member 91 and the ball 92. Note that, although the spring 93 is configured by a compression coil spring in the present embodiment, a biasing member that biases the ball 92 is not limited to the compression coil spring, and may be another type of spring or an elastic body such as resin.

According to the restriction mechanism 90, in a case where the right moving pin 50R tries to move in the vertical direction in a state where the operation lever 80 is located at the neutral position, the ball 92 tries to climb over the first recess 51*a*. At this time, the ball 92 is pressed against the first recess 51*a* by the spring 93, and the movement of the moving pin 50R in the vertical direction is restricted. Thus, the operation lever 80 can be prevented from backlashing in the left-right direction near the neutral position due to vibration or the like during traveling of the tractor 1.

In particular, in the present embodiment, not only the right moving pin 50R but also the movement of the left moving pin 50L is restricted by the restriction mechanism 90. As a result, it is possible to suppress backlash of the operation lever 80 in the front-rear direction near the neutral position, so that the influence of the backlash can be effectively reduced.

Furthermore, when a predetermined operation load or more is applied to the operation lever 80 located at the neutral position, the operator can move the moving pin 50 up and down against a biasing force of the spring 93. In a case where the ball 92 climbs over the first recess 51*a* along with the movement, the second recess 51*b* abuts on the ball 92. In a case where the operation lever 80 is further operated in this state, the moving pin 50 moves in the vertical direction while the ball 92 is guided by the second recess 51*b*. As described above, in the present embodiment, even after the ball 92 climbs over the first recess 51*a*, the ball 92 is continuously released toward the second through hole 32 by the other recess (second recess 51*b*).

As a result, the biasing force of the spring 93 can be made relatively small, so that it is possible to suppress an increase in the operation load after the operation lever 80 is moved from the neutral position, and it is possible to suppress a decrease in operability.

Furthermore, the accommodation member 91 of the present embodiment is screwed into the communication hole 33. According to this configuration, the biasing force of the spring 93 can be easily adjusted by adjusting a screwing amount of the accommodation member 91 into the communication hole 33.

Furthermore, in the present embodiment, the flat portion 53*a* of the moving pin 50 is disposed between the support member 30 and the coupling member 70 (see FIG. 3). With this configuration, since the flat portion 53*a* can be visually recognized from the outside, circumferential positions of the first recess 51*a* and the second recess 51*b* can be easily grasped using the flat portion 53*a* as a mark.

As described above, the operation mechanism 20 of the front loader 11 according to the present embodiment includes the operation lever 80, the moving pin 50 (moving member) that is movable in a predetermined direction (vertical direction) according to the operation of the operation lever 80 and is connected to the control valve 16, and the restriction mechanism 90 that restricts the movement of the moving pin 50 in a state where the operation lever 80 is operated to the neutral position.

With this configuration, the influence of backlash of the operation lever 80 can be reduced.

Furthermore, the restriction mechanism 90 includes the ball 92 (abutment member) capable of abutting on the surface of the moving pin 50, and the spring 93 (biasing member) that biases the ball 92 toward the moving pin 50 (see FIG. 5).

With this configuration, the influence of backlash of the operation lever 80 can be reduced with a simple configuration.

Furthermore, the moving pin 50 includes the first recess 51*a* engageable with the ball 92 in a state where the operation lever 80 is operated to the neutral position (see FIG. 5).

With this configuration, the influence of backlash of the operation lever 80 can be effectively reduced.

Furthermore, the moving pin 50 includes the second recess 51*b* that is formed to extend along the moving direction (vertical direction) of the moving pin 50 and guides the ball 92 (see FIG. 5).

With this configuration, it is possible to suppress an increase in the operation load of the operation lever 80 due to the provision of the restriction mechanism 90.

Furthermore, the support member 30 in which the second through hole 32 (accommodation portion) that accommodates the moving pin 50 is formed is further provided, and the restriction mechanism 90 is provided in the communication hole 33 that communicates the outer surface of the support member 30 and the second through hole 32 (see FIG. 5).

With this configuration, the restriction mechanism 90 can be easily provided from the outside of the support member 30.

Furthermore, the moving pin 50 includes a boom moving member (the left moving pin 50L) that controls the operation of the boom 12 of the front loader 11 and a bucket moving member (the right moving pin 50R) that controls the operation of the bucket 13 of the front loader 11.

With this configuration, it is possible to reduce the influence of backlash of the operation lever 80 in the two operation directions (the directions in which the boom 12 and the bucket 13 are operated).

Furthermore, as described above, the tractor 1 (working vehicle) according to the present embodiment includes the operation mechanism 20 of the front loader 11.

With this configuration, the influence of backlash of the operation lever 80 can be reduced.

Note that the moving pin 50 according to the present embodiment is an embodiment of the moving member according to the disclosure.

Furthermore, the ball 92 according to the present embodiment is an embodiment of the abutment member according to the disclosure.

Furthermore, the spring 93 according to the present embodiment is an embodiment of the biasing member according to the disclosure.

Furthermore, the second through hole 32 according to the present embodiment is an embodiment of the accommodation portion according to the disclosure.

Furthermore, the tractor 1 according to the present embodiment is an embodiment of a working vehicle according to the disclosure.

Although the embodiments of the disclosure have been described above, the disclosure is not limited to the above configurations, and various modifications can be made within the scope of the invention described in the claims.

For example, the working vehicle according to the present embodiment is the tractor 1, but the type of the working vehicle is not limited thereto. The working vehicle may be another agricultural vehicle, a construction vehicle, an industrial vehicle, or the like.

Furthermore, in the present embodiment, the movement of the left and right moving pins 50L and 50R is restricted, but the restriction mechanism 90 according to the disclosure may restrict the movement of at least one moving pin 50.

Furthermore, the configuration of the restriction mechanism 90 is not limited to the present embodiment as long as the movement of the moving pin 50 can be restricted. For example, a member having a shape different from the spherical shape (ball 92) can be brought into contact with the moving pin 50.

Furthermore, although the first recess 51*a* is formed in a substantially hemispherical shape, the shape of the first recess 51*a* can be appropriately changed according to the shape or the like of the abutment member to abut on the moving pin 50. Furthermore, the second recess 51*b* is formed in a substantially arc shape in plan cross-sectional view, but the shape of the second recess 51*b* can be appropriately changed according to the shape or the like of the abutment member.

Furthermore, although the moving pin 50 moves in the vertical direction according to the operation of the operation lever 80, this is an example, and the moving direction of the moving pin 50 can be arbitrarily changed.

Figure 7:
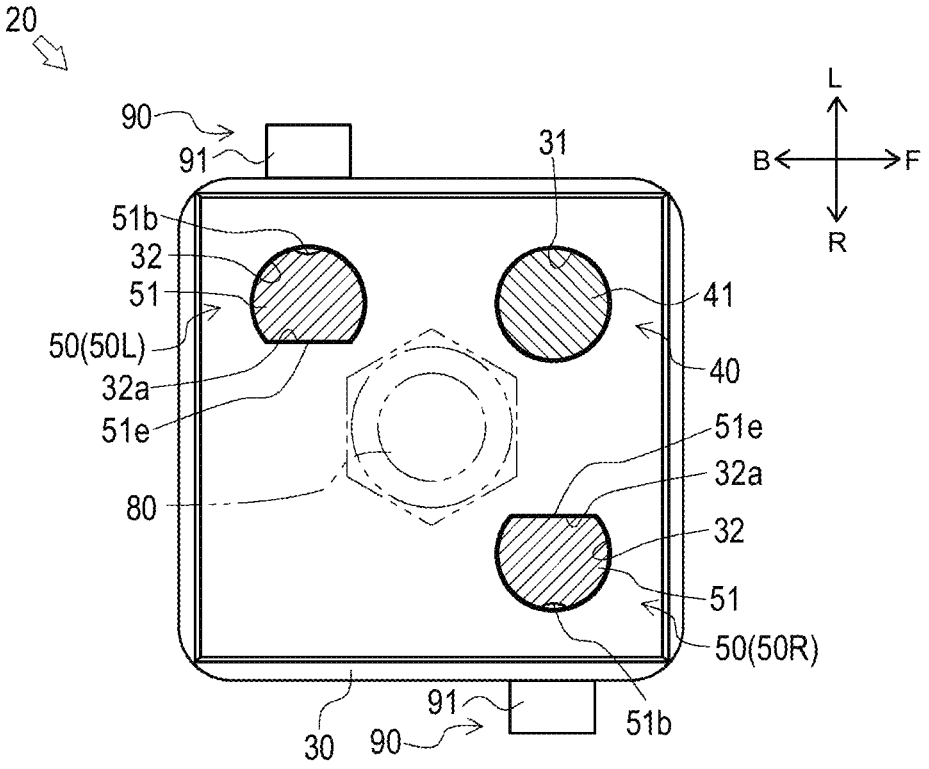
FIG. 7 is a plan view illustrating a second through hole and a moving pin according to a modification.

Furthermore, although the second through hole 32 and the moving pin 50 (columnar portion 51) are formed in a circular shape in plan view, this is an example, and the second through hole and the moving pin may be formed in a shape different from a circle in plan view. For example, as illustrated in FIG. 7, the second through hole 32 and the moving pin 50 may be formed in a shape in which a part of a circle is cut out in plan view. In FIG. 7, flat portions 32*a* and 51*e* facing the left-right direction are formed in the second through hole 32 and the moving pin 50. According to this configuration, when the moving pin 50 tries to rotate about its axis, the flat portions 32*a* and 51*e* come into contact with the moving pin, and the rotation of the moving pin 50 can be restricted.

As described above, the moving pin 50 includes the flat portion 51*e* (rotation restriction portion) that restricts the rotation about the axis parallel to the moving direction (vertical direction) of the moving pin 50.

With such a configuration, it is possible to easily position the moving pin 50 with respect to the support member 30 (accommodation portion). As a result, the moving pin 50 (columnar portion 51) can be quickly accommodated in the support member 30.

Note that the flat portion 51*e* illustrated in FIG. 7 is an embodiment of the rotation restriction portion according to the disclosure.

The rotation restriction portion is not limited to the flat portion 51*e* as long as the rotation restriction portion can restrict the rotation of the moving pin 50. For example, the rotation restriction portion may be an uneven portion or the like formed on the columnar portion 51.

What is claimed is:

1. An operation mechanism of a front loader, the operation mechanism comprising:

an operation lever;

a moving member movable in a predetermined direction according to an operation of the operation lever and connected to a control valve; and a restriction mechanism configured to restrict movement of the moving member in a state where the operation lever is operated to a neutral position, wherein the restriction mechanism includes:

an abutment member capable of abutting on a surface of the moving member, and a biasing member configured to bias the abutment member toward the moving member, and wherein the moving member includes a first recess engageable with the abutment member in a state where the operation lever is operated to the neutral position.

2. The operation mechanism of a front loader according to claim 1, wherein the moving member includes a second recess formed to extend along a moving direction of the moving member and configured to guide the abutment member.

3. A working vehicle comprising the operation mechanism of a front loader according to claim 2.

4. The operation mechanism of a front loader according to claim 1, wherein the moving member includes a boom moving member configured to control an operation of a boom of the front loader, and a bucket moving member configured to control an operation of a bucket of the front loader.

5. A working vehicle comprising the operation mechanism of a front loader according to claim 4.

6. A working vehicle comprising the operation mechanism of a front loader according to claim 1.

7. An operation mechanism of a front loader, the operation mechanism comprising:

an operation lever;

a moving member movable in a predetermined direction according to an operation of the operation lever and connected to a control valve;

a restriction mechanism configured to restrict movement of the moving member in a state where the operation lever is operated to a neutral position, wherein the restriction mechanism includes:

an abutment member capable of abutting on a surface of the moving member, and a biasing member configured to bias the abutment member toward the moving member; and further comprising a support member in which an accommodation portion that accommodates the moving member is formed, wherein the restriction mechanism is provided in a communication hole that communicates an outer surface of the support member and the accommodation portion.

8. The operation mechanism of a front loader according to claim 7, wherein the moving member includes a rotation restriction portion configured to restrict rotation about an axis parallel to a moving direction of the moving member.

9. A working vehicle comprising the operation mechanism of a front loader according to claim 8.

10. A working vehicle comprising the operation mechanism of a front loader according to claim 7.

* * * * *